US005577702A

United States Patent [19]

Chubb et al.

[11] Patent Number: 5,577,702

[45] **Date of Patent: *Nov. 26, 1996**

[54] WALL MOUNTING ASSEMBLY

[75] Inventors: Norman L. Chubb, Carleton; Richard J. MacLeod, Milford; Charles E. Schiedegger, Metamora, all of Mich.

[73] Assignee: Mid-America Building Products Corporation, Plymouth, Mich.

[ * ] Notice: The term of this patent shall not extend beyond the expiration date of Pat. No. 5,397,093.

[21] Appl. No.: 366,883

[22] Filed: Dec. 30, 1994

Related U.S. Application Data

[63] Continuation-in-part of Ser. No. 228,956, Apr. 18, 1994, Pat. No. 5,397,093, which is a continuation of Ser. No. 930,981, Aug. 17, 1992, abandoned, which is a continuation-in-part of Ser. No. 904,384, Jun. 25, 1992, Pat. No. 5,326,060.

[51] Int. Cl.[6] ..... E06B 1/02

[52] U.S. Cl. ..... 248/544; 52/28; 248/220.21

[58] Field of Search ..... 52/28, 211; 248/220.21, 248/221.11, 544, 909; 362/145, 147

[56] References Cited

U.S. PATENT DOCUMENTS

| | | | |
|---|---|---|---|
| 1,484,001 | 2/1924 | Ainsworth | 248/300 |
| 4,222,093 | 9/1980 | Garcia et al. | 362/147 |
| 4,635,168 | 1/1987 | Crowley | 362/147 |
| 4,726,152 | 2/1988 | Vagedes et al. | 248/300 |
| 4,920,708 | 5/1990 | MacLeod et al. | 52/60 |
| 4,920,709 | 5/1990 | Garries et al. | 52/211 |
| 5,000,409 | 3/1991 | MacLeod et al. | 248/205.1 |
| 5,397,093 | 3/1995 | Chubb et al. | 248/544 |

*Primary Examiner*—Ramon O. Ramirez
*Assistant Examiner*—Derek J. Berger
*Attorney, Agent, or Firm*—Barnes, Kisselle, Raisch, Choate, Whittemore & Hulbert, P.C.

[57] ABSTRACT

A wall mounting bracket comprising a plastic body which includes a wall having an integral projection facing outwardly with a centering recess to receive the tip of a hole saw or the like. At least one opening is provided through the wall adjacent the projection. Preferably, a plurality of openings are provided at equally spaced radial locations adjacent the projection. In use, the body is mounted on the building and then siding is applied to the wall of the building and the edges of the siding or brought into closely adjacent relation with the plastic body. In a preferred form, the centering recess is provided on both sides of the wall.

4 Claims, 3 Drawing Sheets

WALL MOUNTING ASSEMBLY

This application is a continuation-in-part of application Ser. No. 08/228,956 filed Apr. 18, 1994, now U.S. Pat. No. 5,397,093, which was a continuation of application Ser. No. 07/930,981 filed Aug. 17, 1992, now abandoned, which was, in turn, a continuation-in-part of application Ser. No. 07/904,384 filed Jun. 25, 1992, now U.S. Pat. No. 5,326,060.

This invention relates to devices for mounting elements such as lighting fixtures, pipes or vents on the wall of a building which has siding thereon.

BACKGROUND AND SUMMARY OF THE INVENTION

In the mounting of devices on the wall of a building having siding, it has been proposed in U.S. Pat. No. 4,920,708 that a one-piece plastic body is provided having a front wall, an integral peripheral wall extending from the front wall and an integral peripheral flange for attachment to a wall of a building. The body is mounted on the building and siding is applied to the wall of the building and the edges of the siding are brought into closely adjacent relation to the peripheral wall of the body. A plastic flange member having an axial wall is telescoped over the peripheral wall of the body until the flange engages the siding. The axial wall of the flange and the peripheral wall of the body have interengaging projections and recesses so that the flange is selectively locked in position.

In U.S. Pat. No. 5,000,409, a one-piece wall mounting bracket is provided which comprises a plastic body including a front wall and an integral peripheral wall extending from the front wall and having a free edge. Diametrically opposed portions of the free edge of the peripheral wall are formed with notches such that those peripheral portions can engage siding on a wall of a building. The portions with the notches are preferably convex to firmly engage the siding. These wall portions can be readily severed to form a straight edge. A portion of the free edge of the wall is formed with a groove for receiving caulking. The groove is defined by a radially peripheral bead on the free edge which includes spaced walls forming the groove for receiving caulking compounds.

In our aforementioned U.S. Pat. No. 5,326,060, we have disclosed a mounting bracket which comprises a one-piece plastic body including a back wall and an integral peripheral wall extending from the back wall. The back wall is attached to the wall of a building. In use, the body is mounted on the building and then siding is applied to the wall of the building and the edges of the siding are bought into closely adjacent relation to the peripheral wall of the body. A plastic flange member having an axial wall telescoped within the peripheral wall of the body and having a flange which engages a free edge of the peripheral wall. The axial wall of the flange and the peripheral wall of the body have interengaging projections and recesses so that the flange is selectively locked in position.

All of the above mentioned mounting brackets include grooves that define weakened lines which adapt the mounting assembly for various devices and uses. However, accurate cutting along the weakened lines is difficult due to the lack of stable support for the cutting tool.

In accordance with the present invention, the concepts set forth in the above entitled application is applied to the problem of adapting the mounting assembly for various devices and uses.

More specifically, in accordance with the present invention, the wall mounting bracket comprises an integral projection facing outwardly with a centering recess to receive the tip of a hole saw or the like for stabilizing the hole saw while cutting along one of the weakened lines. Furthermore, at least one, and preferably a plurality of radially spaced openings, is provided through the wall adjacent the projection.

DESCRIPTION

Figure 1:
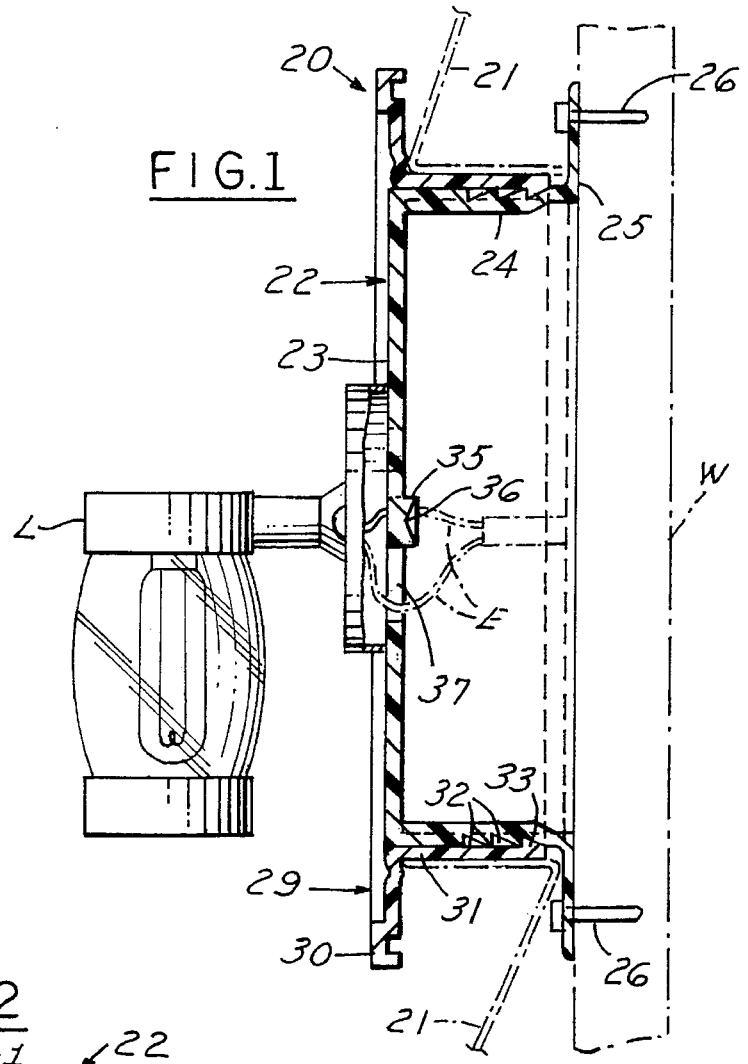
FIG. 1 is a sectional view taken along the line 1—1 in FIG. 2.

Referring to FIG. 1, the mounting bracket assembly embodying the invention is shown as applied to a wall having siding 21 thereon for supporting a device such as a light fixture L. The assembly 20 includes a main one-piece body 22, made of plastic, such as polypropylene. The body 22, herein shown as rectangular, includes a planar wall 23, an integral peripheral wall 24 extending axially from the periphery of the wall 23 and an outwardly extending peripheral wall or flange 25 extending from the edge of the wall 24 and parallel to the wall 23. The body 22 is adapted to be fastened to the wall W of a building by fasteners such as nails 26 extending through elongated slots 27 in the flange 25. The siding 21 is then applied to close proximity with the wall 24. The mounting assembly 20 further includes a plastic flange member 29 having a flange wall 30 which in turn has an axial wall 31 adjacent the inner periphery thereof. After the siding is applied, the flange member 29 is telescoped over the wall 24 into engagement with the siding 21. The peripheral wall 24 includes circumferentially and axially spaced grooves 32 which are selectively engaged by axially spaced projections 33 on the inner surface of a wall 31 of the flange member 29 to hold the flange member 29 in proper adjusted position closely adjacent the siding. The grooves 32 and projections 33 are preferably formed at diametrically opposed positions on their respective members.

Figure 2:
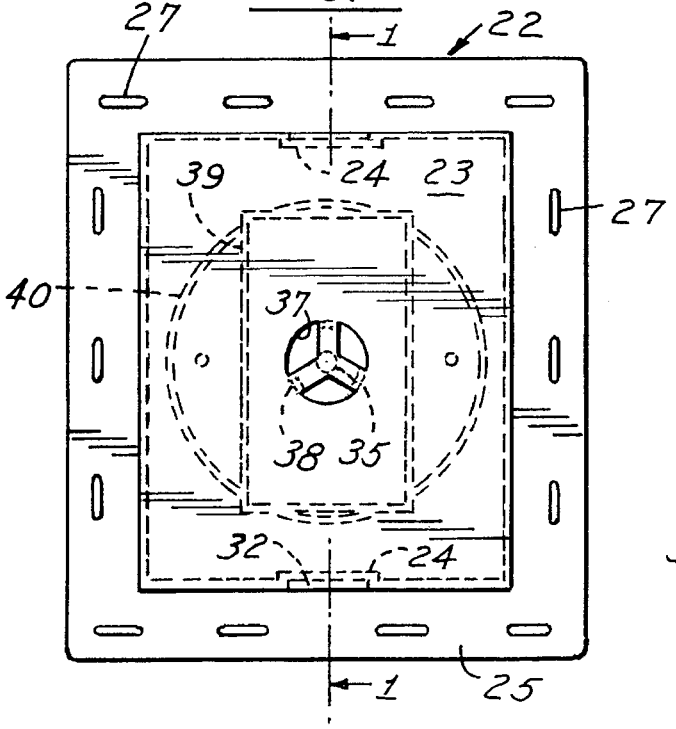
FIG. 2 is a plan view of the bracket assembly of FIG. 1 with the light fixture removed.
Figure 3:
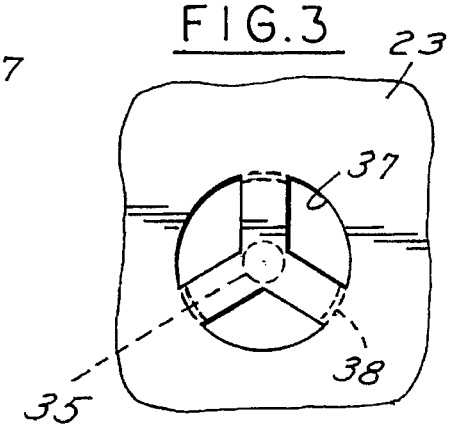
FIG. 3 is a fragmentary view on an enlarged scale of the integral projection.

As shown in FIG. 2, the undersurface of wall 23 is formed with grooves that define weakened lines which adapt the mounting assembly for various devices and uses. The underside of the wall 23 further includes a central small diameter projection 35 having a centering recess 36 which defines a support to receive a bit of a hole saw or the like. At least one, but preferably a plurality of openings 37 are equally radially spaced about the projection 35. The spaces 37 are adapted to enable wires E to extend therethrough to the lighting fixture L without having to cut a hole (FIG. 1).

For adapting the device for a water pipe or the like, a central small diameter groove 38 is provided defining an area that can be removed to accommodate the pipe. Further, the wall includes a rectangular groove 39 which defines a rectangle for use in association with an electrical box that is rectangular. In addition, the front wall is formed with a large circular groove 40 for use with an electrical box that is octagonal or for use where the mounting assembly is to be connected to a vent such as that of a clothes dryer. Thus, the bracket assembly readily provides a wall 23 that can be adapted by a worker or user for various purposes.

Figure 4:
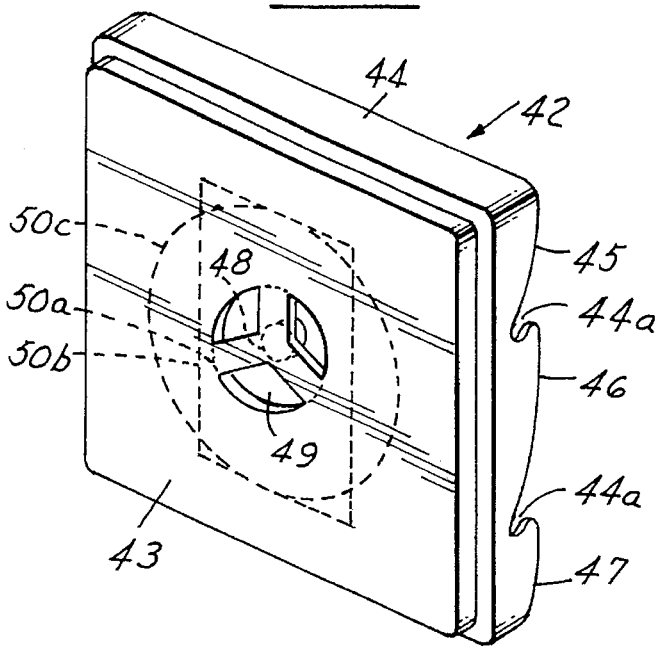
FIG. 4 is a perspective view of another embodiment of the invention.

In the embodiment of FIG. 4, a one-piece mounting bracket 42 is provided and comprises a one-piece plastic body, such as polypropylene, that includes a front wall 43 and a peripheral wall 44 having a free edge. Diametrically opposed side portions of the free edge of the peripheral wall 44 are provided with notches 44*a* and siding engaging surfaces 45, 46 and 47. Each of the surfaces 45, 46, 47 is preferably convex to engage firmly the siding. The bracket 42 is attached to the wall by screws (not shown). The wall 43 is provided on the inside thereof with an integral outwardly facing projection 48 with the centering recess similar to that seen at 35 in FIG. 1. Similarly, a plurality of radially spaced openings 49 are provided about the projection 48 to allow access for wires. Additionally, the interior of the wall 43 is formed with arcuate grooves 50*a*, straight grooves 50*b*, and a circular groove 50*c* to define area that may be cut out of the wall to accommodate for use with water pipes or the like.

Figure 5:
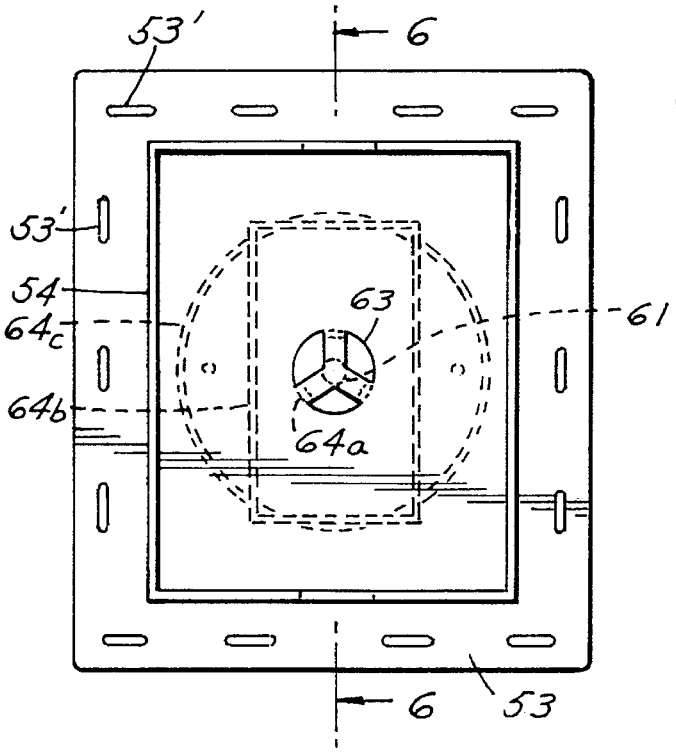
FIG. 5 is a plan view of one member of yet another embodiment of the invention.
Figure 6:
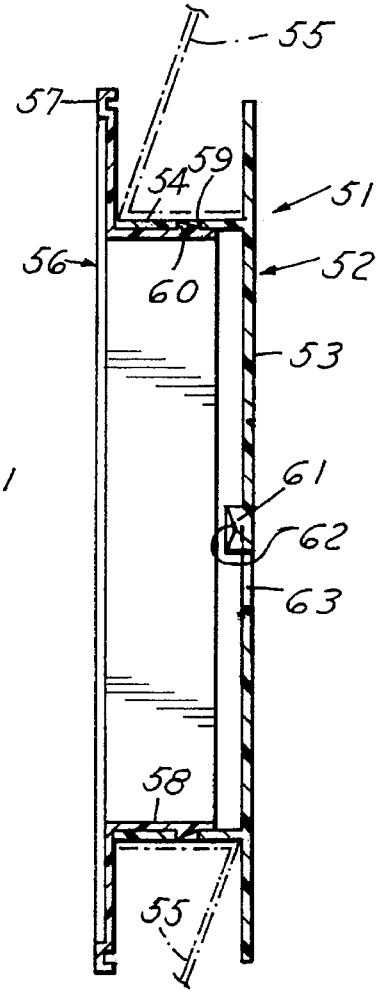
FIG. 6 is a sectional view taken along the line 6—6 of FIG. 5 with the flange member added.

FIGS. 5 and 6 show yet another embodiment of the invention wherein a mounting bracket assembly 51 is shown which comprises a mounting 52 having a back wall 53 and an integral peripheral wall 54. The back wall 53 is adapted to be mounted to the wall of a house (not shown) by any means such as by nails (not shown) extending through elongated slots 53' in the back wall 53. After mounting the mounting bracket 52 to the wall, siding 55 is applied thereto in close proximity to the peripheral wall 54. Thereafter, flange member 56 is connected thereto which comprises an outer flange wall 57 and an integral peripheral wall 58 extending inwardly from an inner periphery thereof. The wall 58 is telescopically received within the wall 54. Wall 54 has a plurality of openings or grooves 59 adapted to receive projections 60 on peripheral wall 58 to hold the flange in proper position with the flange 57 closely adjacent the siding 55. The back wall 53 includes a central outwardly facing integral projection 61 with a centering recess 62 and openings 63 and weakened arcuate score lines 64*a*, straight score lines 64*b*, and a circular score line 64*c* are provided as described above.

Figure 7:
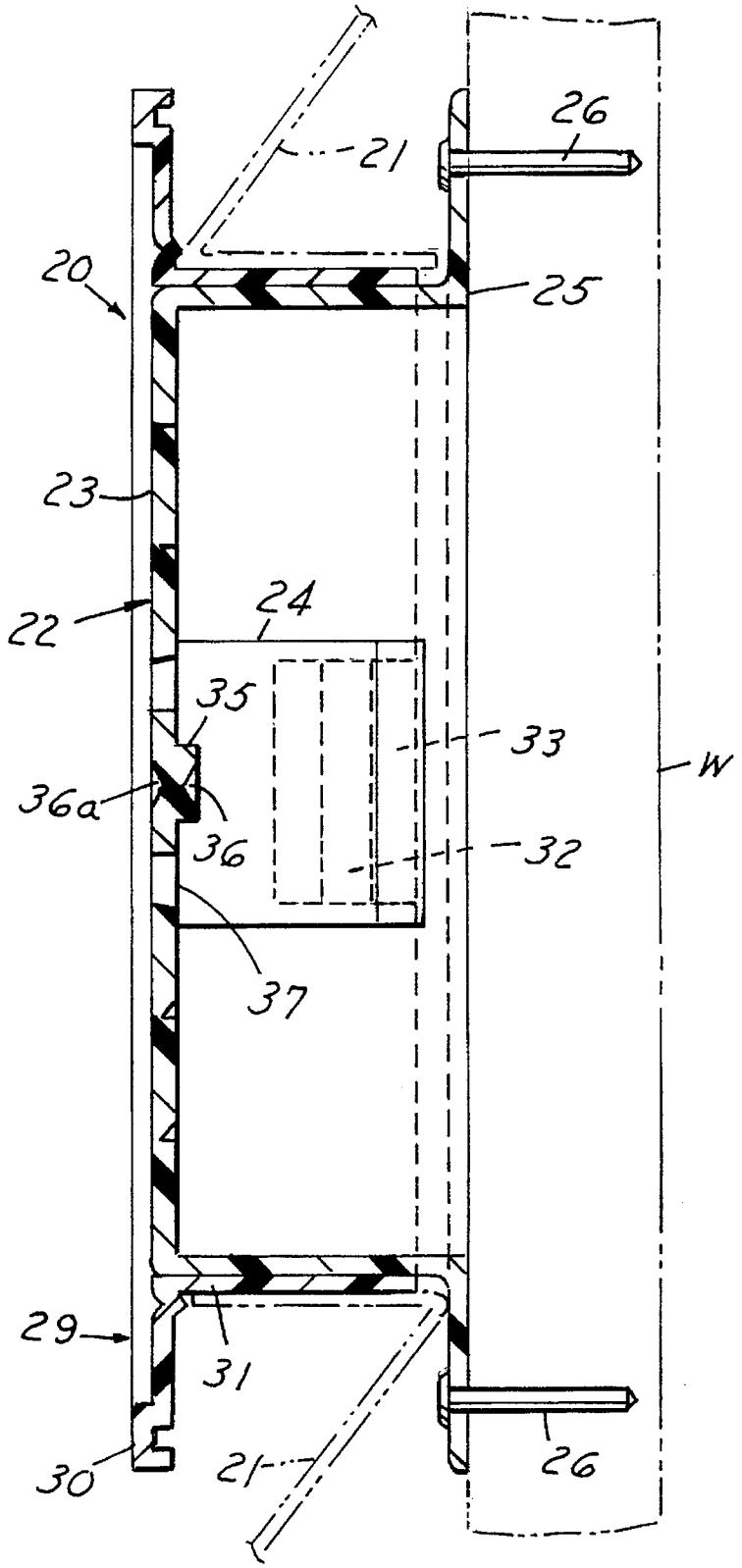
FIG. 7 is a sectional view similar to FIG. 1 showing a modified form of the invention.

In the modified form shown in FIG. 7, an additional outwardly facing recess 36*a* is provided in the inner surface of the wall panel 23.

What is claimed is:

1. A wall mounting bracket comprising a plastic body including a wall panel with inner and outer surfaces, means for mounting the wall panel to the wall of a building, means for facilitating the location of a tip of a hole saw for cutting said wall panel comprising an integral outwardly facing projection on the outer surface and the inner surface of the wall panel, said projection having a centering recess with a configuration therein adapted to receive a tip of a hole saw, and a plurality of equally spaced openings spaced about said projection, said wall panel having a plurality of arcuate lines having a center at a center of said centering recess, said arcuate lines being positioned between radially outer edges of said spaced openings such that when it is desired to cut said wall panel along said arcuate lines, the tip of a hole saw is placed in the centering recess to guide the hole saw.

2. The wall mounting bracket set forth in claim 1 wherein said wall panel comprises additional lines surrounding the arcuate lines in the outer surface thereof forming lines of demarcation for cutting a larger portion of the wall panel, at least one of said additional lines being circular such that when it is desired to cut said wall panel along said circular line, the tip of a hole saw is placed in the centering recess on the outer surface or the inner surface to guide the hole saw.

3. The wall mounting bracket set forth in claim 2 wherein said arcuate and said additional lines comprise grooves.

4. The wall mounting bracket set forth in claim 1 including a plastic flange member in telescoping relation with said plastic body and interengaging means between said flange member and said plastic body.

* * * * *